US005308178A

United States Patent [19]

Jiang

[11] Patent Number: 5,308,178

[45] Date of Patent: May 3, 1994

[54] WRITING INSTRUMENT

[75] Inventor: Curtis T. Jiang, San Francisco, Calif.

[73] Assignee: QLH USA Inc., San Francisco, Calif.

[21] Appl. No.: 69,921

[22] Filed: Jun. 1, 1993

[51] Int. Cl.[5] ..... B43K 9/00

[52] U.S. Cl. ..... 401/8; 401/131; 401/98; 401/202

[58] Field of Search ..... 401/6–8, 401/131, 88, 98, 202, 213, 244, 247

[56] References Cited

U.S. PATENT DOCUMENTS

| | | | |
|---|---|---|---|
| D. 202,843 | 11/1965 | Dales | D74/17 |
| D. 207,563 | 5/1967 | Bailey | D74/17 |
| D. 276,479 | 11/1984 | Mori | D3/62 |
| D. 280,110 | 8/1985 | Brooks | D19/42 |
| D. 306,177 | 2/1990 | Park | D19/36 |
| D. 310,449 | 9/1990 | Agrippino | D3/62 |
| 863,915 | 8/1907 | Graves | 401/98 |
| 1,544,971 | 7/1925 | Gadomski | 401/8 |
| 1,795,555 | 3/1931 | Greenwood . | |
| 1,838,543 | 12/1931 | Goldstein | 401/244 X |
| 1,859,775 | 5/1932 | Hyams | 401/98 |
| 3,168,072 | 2/1965 | Nitta | 120/83 |
| 4,037,975 | 7/1977 | Huffman | 401/6 |
| 4,317,638 | 3/1982 | Klaber | 401/195 |
| 4,588,317 | 5/1986 | Taylor | 401/131 |
| 4,706,995 | 11/1987 | Dopp | 401/6 X |

FOREIGN PATENT DOCUMENTS

| | | | |
|---|---|---|---|
| 382902 | 8/1990 | European Pat. Off. | 401/213 |
| 3501576 | 8/1985 | Fed. Rep. of Germany | 401/131 |

*Primary Examiner*—Danton D. DeMille

[57] ABSTRACT

A generally planar writing instrument comprises a cap with anchoring and clipping means for attachment to a key ring, a watchband, a shirt pocket or the like, and a holder having finger gripping recessed surfaces and fastening means adapted to temporarily retain the holder on a finger of a user between uses as well as to securely store the holder in the cap when not in use.

11 Claims, 2 Drawing Sheets

WRITING INSTRUMENT

BACKGROUND OF THE INVENTION

1. Field of Invention

This invention deals with a generally planar writing instrument which can be conveniently carried by attaching to a key ring, a watchband, a shirt pocket or the like, and which can be mounted on a finger of a user for temporary retention.

2. Description of Prior Art

A common problem with convention writing instruments is in the fact that their elongated rod-like structures and pocket clips do not offer a convenient way of carrying; therefore, it is not infrequent that a person going away from home with no shirt pocket may find himself or herself with no writing instrument whatever when something needs to be put down on memo or paper.

Known prior art patents attempting to solve this problem are as follows:

| | |
|---|---|
| U.S. Pat. No. D202,843 | Dales |
| U.S. Pat. No. D207,563 | Bailey |
| U.S. Pat. No. D276,479 | Mori |
| U.S. Pat. No. D280,110 | Brooks |
| U.S. Pat. No. D306,177 | Park |
| U.S. Pat. No. D310,449 | Agrippino |
| U.S. Pat. No. 1,795,555 | Greenwood |
| U.S. Pat. No. 3,168,072 | Nitta |
| U.S. Pat. No. 4,317,638 | Klaber |
| U.S. Pat. No. 4,588,317 | Taylor |

All of this prior art has failed to produce a writing instrument which is comfortable to use, convenient to carry, as well as capable of engaging a finger of a user for temporary retention.

SUMMARY OF THE INVENTION

The main object of the present invention is to provide a generally planar writing instrument which may be carried by attachment to a key ring, a watchband, a shirt pocket or the like for convenient carrying and immediate access.

Another object of the present invention is to provide a writing instrument which may be easily detached from a key ring for use.

A further object of the present invention is to provide a writing instrument which is small in size for comfortable placing in the pocket of a user.

An additional object of the present invention is to provide a writing instrument which comprises recessed body surfaces for engagement by a thumb and another finger, particularly a forefinger.

Yet another object of the present invention is to provide a writing instrument which may be temporarily retained on a finger when not in use, thereby allowing the continued use of the writing instrument without setting it down.

A still further object of the present invention is to provide a writing instrument in which the instrument holder can be made in any shape to make its outer appearance more attractive.

Yet another object of the present invention is to provide a writing instrument which has roomy body surfaces for having attractive and/or advertising material imprinted thereon.

Still other features and advantages of the present invention will become apparent in view of the following description of the drawings and appended claims.

BRIEF DESCRIPTION OF THE DRAWINGS

FIG. 7 are cross sectional views through the lid and the holder shown in FIG. 2.

FIG. 8 is a side view of the holder shown gripped by a thumb and a forefinger of a user.

LIST OF REFERENCE NUMERALS

Figure 1:
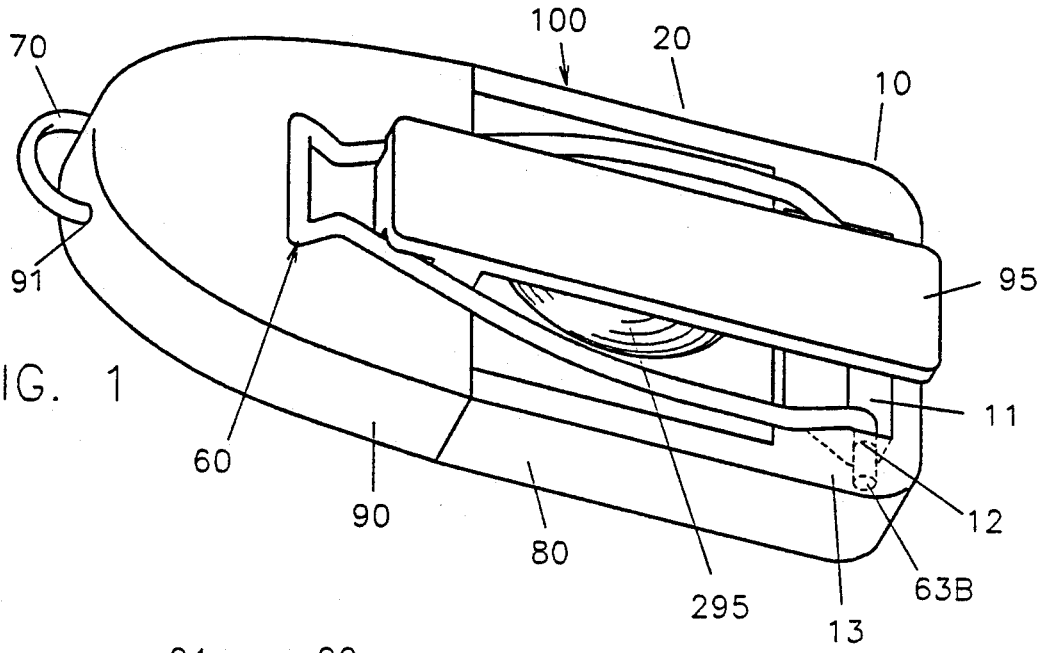
FIG. 1 is a perspective view of a writing instrument in accordance with the present invention.

10 upper section
- 11 Concave
- 12 Cylindrical compartments
- 13 Front face of holder 80

20 Body section
- 21 Upper aslant portion
- 22 Internal chamber
- 24 Back face of holder 80
- 25 Finger seat
- 26 Inner convex
- 27 Corner knobs
- 280 Aperture
  - 281 Supporting flange
  - 282 Supporting wall
- 290 Lid
  - 295 Thumb seat
  - 297 Protruding rib
  - 299 peripheral edge of body section 20

30 Lower section
- 31 Lower aslant portion
- 32 Tip-receiving tubular bore

50 Writing tip
- 51 Y-shaped ink reservoir

60 Tension fastener
- 61 Top frame
  - 61A Top handle
  - 61B Side members
- 62 Middle frame
  - 62A Upper side members
  - 62B Lower side members
- 63 Bottom frame
  - 63A Side members
  - 63B Hooking members

70 Resilient semi-circular anchor
- 71 Hooking leg portions

80 Holder

90 Cap
- 91 A pair of through holes
- 92 upper portion
- 93 Corner grooves
- 94 Front face
- 95 Clipping arm
- 96 Protrusion

100 Writing instrument

DETAILED DESCRIPTION OF THE DRAWINGS

Referring now to FIG. 1 of the drawings, the generally planar writing instrument 100 of the present invention can be seen as being in a storage position and being comprised of two basic parts: a holder 80 and a cap 90. Both are preferably injection molded in a suitable die, formed of a synthetic resin having good strength and dimensional stability, and capable of taking an attractive and long wearing surface.

Figure 2:
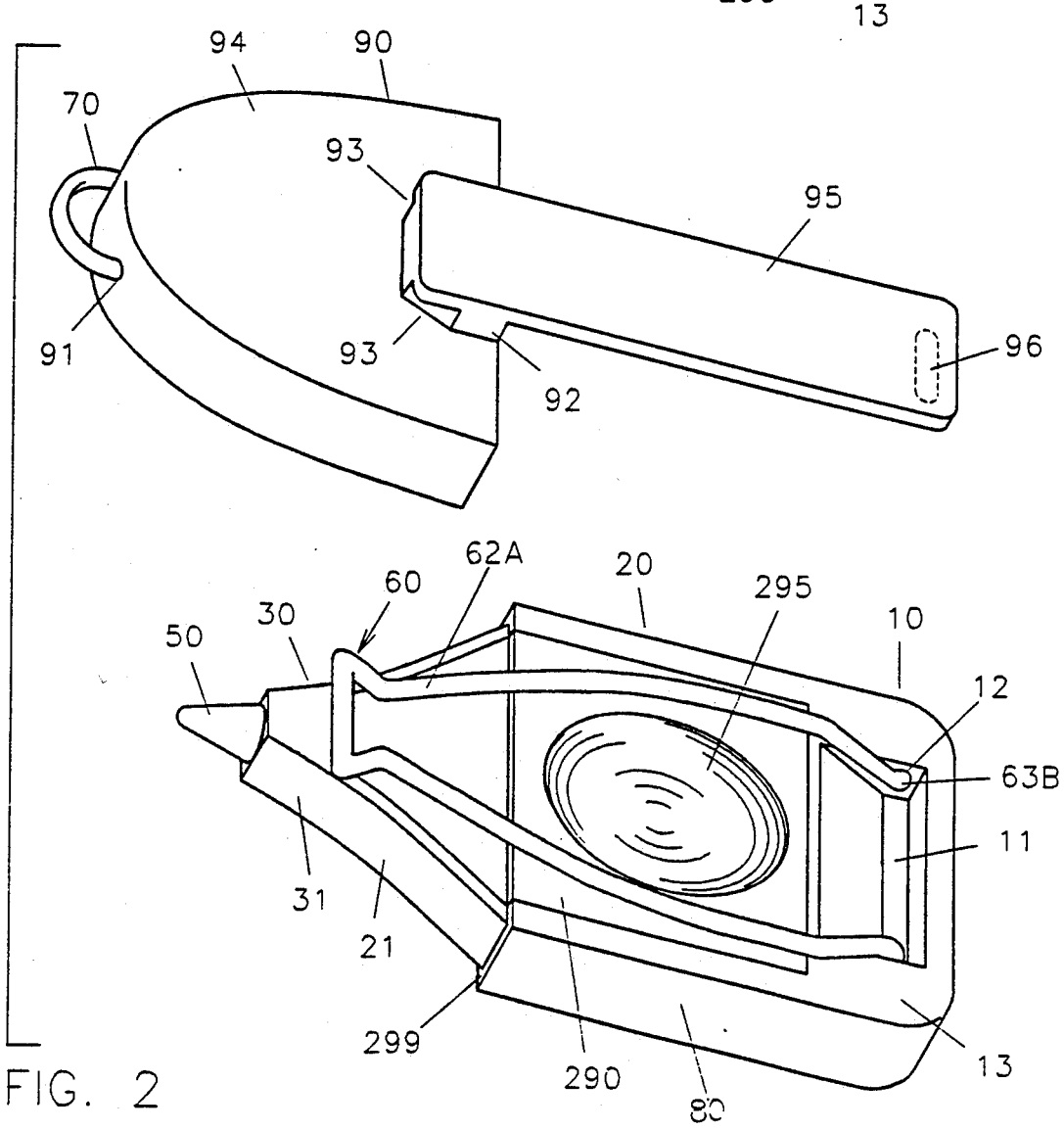
FIG. 2 are a perspective views of two basic parts of the writing instrument of FIG. 1: a cap with an anchor and a clip, and a holder with a fastener and a lid.

Most of the components of the instrument 100 are illustrated in more detail in FIG. 2. Cap 90 comprises a radial end having, on both of its substantially uppermost sloping edges near the top, a pair of through holes 91 engaging a resilient semi-circular anchor 70 for receipt of an endless loop, a key ring or the like, an open end configured to fully contain a lower aslant structure of holder 80, and the elongated rectangular clipping arm 95 having an upper portion 92 permanently affixed by molding operation to a front surface 94 and adjacent to a front margin of the open end of cap 90. Upper portion 92 has atop two corner grooves 93 adapted to releasably engage a pair of resilient side members 62A of a fastener 60, thereby releasably securing holder 80 in cap 90. Side members 62A can be snapped into or out of corner grooves 93 by a hand movement of a user utilizing a top handle 61A (FIG. 6) of fastener 60. Clipping arm 95 with a protrusion 96 on its under surface serves to clip instrument 100 to a watchband, a shirt pocket, a sheet or the like.

Holder 80 includes an upper section 10, a body section 20, and a lower section 30. On a front face 13 of holder 80, Upper section 10 has a central and generally rectangular concave 11 so beveled as to provide a pair of opposite hook-receiving cylindrical compartments 12 engaging two hooking members 63B of tension fastener 60.

The exterior of the body section 20 comprises a lid 290 having a finger seat 295 formed on front face 13, a thumb seat 25 formed on a back face 24 (FIG. 7), and an upper aslant portion 21 having a peripheral edge 299 extending around the entire periphery of its topmost margin to fittingly support a peripheral lip of the open end of cap 90 for storage of instrument 100 (FIG. 1).

Figure 3:
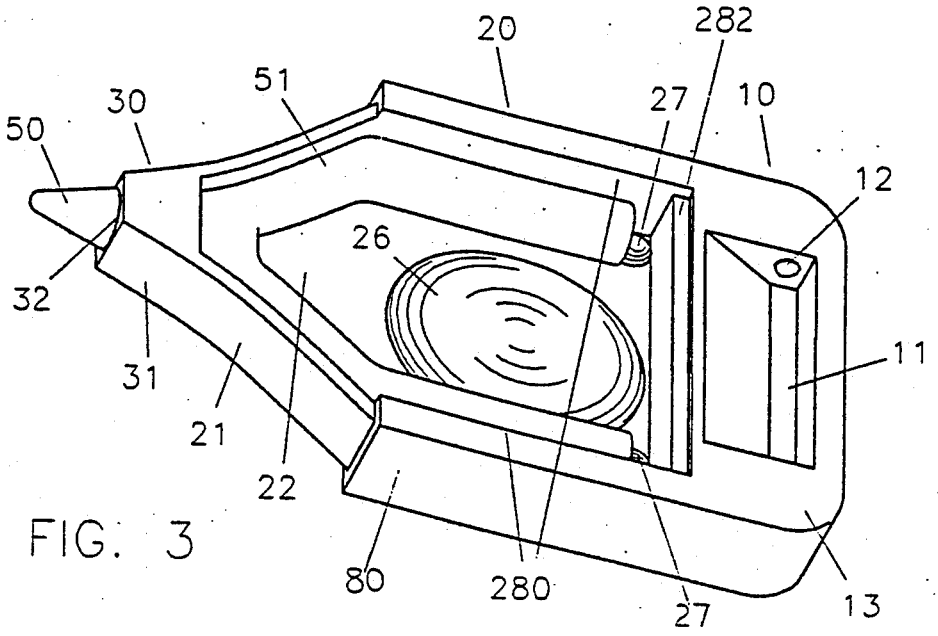
FIG. 3 is a perspective view of the holder without the tension fastener and the lid.

As seen in FIG. 3, the lower section 30 has a lower aslant portion 31 continuous with upper aslant portion 21, and a tip-receiving tubular bore 32 for receipt of a converging end of a generally y-shaped ink reservoir 51 with which a writing tip 50 is engaged and is adapted to be extended through said tubular bore.

The interior of holder 80 comprises an internal chamber 22, an aperture 280 defining an opening for chamber 22, a pair of corner knobs 27 designed to securely retain the force-inserted ink reservoir 51 within chamber 22, and an inner convex 26 formed as a result of the outer thumb seat 25 (FIG. 7) but not having an operating function in this invention.

Figure 4:
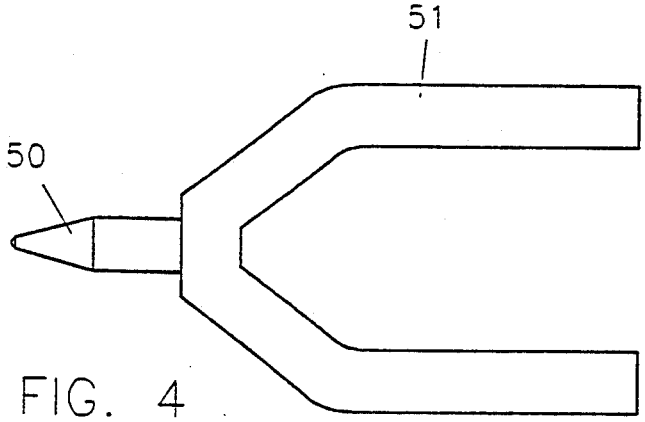
FIG. 4 is a top plan view of a combined writing tip and ink reservoir of the writing instrument.
Figure 5:
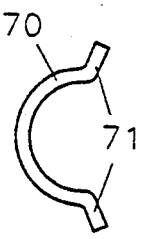
FIG. 5 is a top plan view of the semi-circular anchor.
Figure 6:
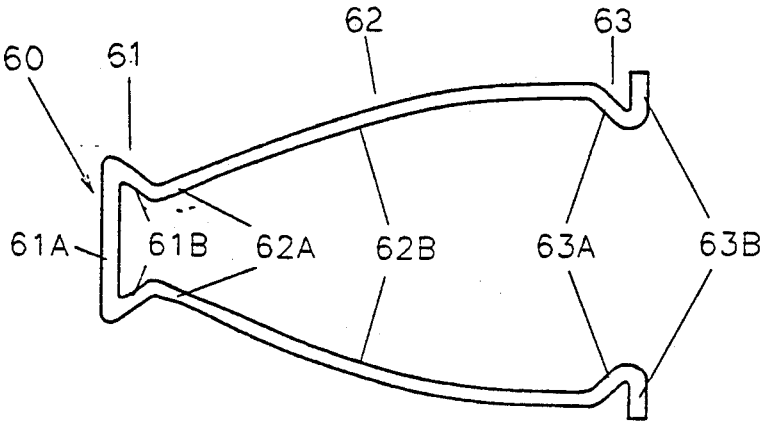
FIG. 6 is a top plan view of the tension fastener.

FIG. 4–6 illustrate top plan views of ink reservoir 51 engaging writing tip 50, resilient semi-circular anchor 70 with a pair of outwardly bent leg portions 71, and tension fastener 60 comprising a top frame 61 having a top handle 61A and inwardly angled side members 61B continuous with outwardly angled upper side members 62A and lower side members 62B of a middle frame 62 continuous with a bottom frame 63 having inwardly angled side members 63A and outwardly angled hooking members 63B parallel to the top handle 61A. Lower side members 62B curve slightly opposite to each other to form a gradually enlarged and curved gap for movably fittingly engaging a finger.

Referring to FIG. 2 again for related and detailed descriptions of FIG. 6, top frame 61 being on a slightly elevated plane is so designed as to provide easy access to top handle 61A to use in snapping upper side members 62A of middle frame 62 into or out of corner grooves 93. Bottom frame 63 is disposed on a suitable sloping plane such that its hooking members 63B can be force-inserted into compartments 12 and that middle frame 62, being on a horizontal plane, can be positioned tangentially on holder 80 for a snap-type action, or elevated so appropriately that side members 62B can receive and hold a finger under pressure.

As will be understood, the gap between side members 62B may be varied at time of manufacture of the instrument to accommodate major differences in finger size as between different users. Relatively minor differences, however, are readily accommodated by the resiliency and the gradually enlarged gap structure of side member 62B.

FIG. 7 shows that lid 290, having two outwardly beveled upper and lower edges and a protruding rib 297 on a back surface of its lower end, is so designed as to be press-fitted in aperture 280 for sealingly covering chamber 22. A supporting flange 281 and a supporting wall 282, extending outwardly from a lower edge and an upper edge of aperture 280, respectively, are provided to support lid 290.

Turning now to the use of the instrument, FIG. 8 shows holder 80 gripped by a forefinger and a thumb. It will be seen that tension fastener 60 can be used to provide pressure against the forefinger for retaining holder 80 when the thumb leaves it for other purposes.

As will be readily understood, the instrument of the present invention may be used with various types of writing tips, such as fiber tip, ball-point tip, and the like. Likewise, due to the generally flat and roomy exteriors of the instrument, the construction of it may vary in configuration as, for example, a shape of a human heart, a face, or a novelty item attractive to different types of users. Accordingly, the preceding description and accompanying drawings are given by way of illustration only and are not intended to limit the present invention, the scope of which is to be defined by the following claims.

What is claimed is:

1. A writing instrument comprising:

a generally planar holder having an upper section continuous with a body section continuous with a lower section, said holder having a lower aslant structure;

a removable planar cap having an open end for receipt of said aslant structure of said holder, and a substantially closed radial end with anchoring means and clipping means thereon for carrying; and fastening means for releasably and safely storing said holder in said cap as well as temporary retaining said holder on a finger of a user.

2. The writing instrument of claim 1 wherein said holder is formed of plastic material by any suitable molding operation.

3. The writing instrument of claim 2 wherein said lower section is a lower aslant portion of said structure having a tip-receiving tubular bore for receipt of a converging end of a generally y-shaped ink reservoir with which a writing tip is engaged and adapted to be extended through said tubular bore.

4. The writing instrument of claim 3 wherein said structure is a combination of said lower section and a lower portion of said body section cut aslant to remove said plastic material such that the shape thereof corresponds to a syncline-shaped end of said ink reservoir, and that a peripheral edge extends around an entire periphery of a topmost margin of said structure to fittingly support a peripheral lip of said open end for storing said holder in said cap.

5. The writing instrument of claim 3 wherein said body section comprising:

a back face, being integral with a back surface of said upper section and said lower section, and having a recessed thumb seat;

an upper aslant portion being integral with said lower aslant portion;

an internal chamber with a pair of corner knobs therein so constructed as to permit force insertion and tight retention of said ink reservoir therein;

an aperture defining a suitable opening for putting said ink reservoir in said chamber, and having an inwardly beveled lower edge with a supporting flange extending outwardly therefrom and an inwardly beveled upper edge with a supporting wall extending outwardly therefrom; and a lid being of a size fitting said aperture and comprising:

a recessed finger seat on an outer surface thereof;

two outwardly beveled upper and lower edges being so designed as to be press-inserted in said upper and lower edges of said aperture, respectively, for a close and tight edge-to-edge relation between said lid and said aperture; and a protruding rib, extending laterally and outwardly from an inner surface thereof near said lower edge thereof, and being so constructed as to be pressed against an outer marginal edge of said supporting flange for reinforcing said edge-to-edge relation.

6. The writing instrument of claim 1 wherein said upper section of said holder has, on a front face thereof, a generally rectangular elongated concave, extending laterally and centrally from a lower end thereof downward toward an upper end thereof, and so beveled as to provide two opposite walls from which a pair of symmetrical hook-receiving cylindrical compartments extending laterally toward two side edges of said upper section.

7. The writing instrument of claim 1 wherein said anchoring means is a semi-circular anchor, formed from a resilient wire bent upon itself to a semi-circular shape, and having a pair of ending leg portions so outwardly bent as to be pressed toward each other for insertion into a pair of through holes which are located symmetrically on two sloping edges near the very top of said radial end of said cap.

8. The writing instrument of claim 1 wherein said clipping means is an elongated rectangular clipping arm, being of a size approximately equal to one third of a width of said upper section, having an upper portion affixed centrally and permanently by molding operation to a front surface of said cap and adjacent a front margin of said open end, and having a lower portion reaching an uppermost margin of said upper section when said cap completely covers said holder.

9. The writing instrument of claim 8 wherein said upper portion of said clipping arm has two corners beveled toward said front surface of said cap and so shaped as to provide two suitable corner grooves into which said fastening means can be snapped for tension storage of said holder in said cap, and said lower portion having on an under surface thereof a protrusion adapted to secure said writing instrument to a shirt pocket, a watchband or a sheet for carrying.

10. The writing instrument of claim 1 wherein said fastening means is a one-piece resilient wire bent upon itself to form a spring type tension fastener with a top frame, formed on a slightly elevated plane having one top member and a first pair of side members angled inwardly to a central bottom end thereof, and continuous with a middle frame, formed on horizontal plane, having a second pair of side members slightly curving opposite to each other and angled outwardly, and continuous with a bottom frame formed on a slightly sloping plane having a third pair of side members angled inwardly and then outwardly to form a pair of hooking members parallel to said top member of said top frame.

11. The writing instrument of claim 10 wherein:

said top frame is so elevated as to provide a suitable handle for a snap-type action to induce or release a tension force holding said fastener against said corner grooves;

said side members of said middle frame provide an uppermost portion sufficiently resilient to permit expansion and to be snapped into or out of said corner grooves, as well as a substantially lengthy body portion in a form of a gradually enlarged gap to movably receive and engage differing sized fingers under pressure; and said bottom frame is so sloped that said pair of hooking members thereof can be press inserted into and held against said hook-receiving compartments under expansion tension, and that said middle frame can be positioned tangentially on said front surface of said holder or lifted therefrom to receive said finger.

* * * * *